US010626633B2

(12) United States Patent
Filiba

(10) Patent No.: US 10,626,633 B2
(45) Date of Patent: Apr. 21, 2020

(54) SECURITY BARRIER

(71) Applicant: Lusio Filiba, Washington, DC (US)

(72) Inventor: Lusio Filiba, Washington, DC (US)

(73) Assignee: COCHRANE USA, INC., Washington, DC (US)

( * ) Notice: Subject to any disclaimer, the term of this patent is extended or adjusted under 35 U.S.C. 154(b) by 153 days.

(21) Appl. No.: 15/690,607

(22) Filed: Aug. 30, 2017

(65) Prior Publication Data

US 2018/0058094 A1 Mar. 1, 2018

(30) Foreign Application Priority Data

Sep. 1, 2016 (ZA) ..... 2016/06059

(51) Int. Cl.
*E04H 17/16* (2006.01)
*E06B 9/02* (2006.01)
*E06B 9/00* (2006.01)

(52) U.S. Cl.
CPC ..... *E04H 17/168* (2013.01); *E06B 9/02* (2013.01); *E04H 17/161* (2013.01); *E06B 2009/002* (2013.01)

(58) Field of Classification Search
CPC ... E04H 17/161; E04H 17/163; E04H 17/165; E04H 17/168; E04H 17/16; E06B 9/0692; E06B 9/02; E06B 2009/002; E06B 9/06; E06B 2009/005; E01F 7/02; E04F 11/1851; E04F 11/1855; E04F 11/1857; F24F 13/082
See application file for complete search history.

(56) References Cited

U.S. PATENT DOCUMENTS 1,860,686 A * 5/1932 Morrison ..... E04H 17/16 256/45
3,037,726 A * 6/1962 Phillips ..... B64F 1/26 181/210
3,452,477 A * 7/1969 Sassano ..... E06B 3/4609 49/116
3,656,576 A * 4/1972 Gubela ..... E01F 8/007 181/210
3,913,889 A * 10/1975 Nugent ..... E01F 7/02 256/12.5
4,248,022 A * 2/1981 Walker ..... E04C 2/384 160/397
4,397,347 A * 8/1983 Brabant ..... E06B 9/0638 160/231.2
5,957,186 A * 9/1999 Boswell ..... E06B 9/02 160/183
6,113,076 A * 9/2000 Hancock-Bogese ..... A01K 3/00 256/1
7,909,686 B2 * 3/2011 Achen ..... F24F 13/082 454/277
9,091,096 B2 * 7/2015 Cochrane ..... E04H 17/161
2007/0170411 A1 * 7/2007 Ribak ..... E01F 13/022 256/32

(Continued)

FOREIGN PATENT DOCUMENTS

WO WO-2016124845 A1 * 8/2016 ..... E04H 17/16

*Primary Examiner* — Matthew R McMahon
(74) *Attorney, Agent, or Firm* — Tutunjian & Bitetto, P.C.

(57) ABSTRACT

A security barrier which includes a sheet metal shutter formed with a plurality of apertures covered by formations which allow air passage but restrict see-through visibility.

10 Claims, 5 Drawing Sheets

(56) References Cited

U.S. PATENT DOCUMENTS

| | | | | |
|---|---|---|---|---|
| 2007/0272908 | A1* | 11/2007 | Sotillos | E04H 17/161 256/35 |
| 2011/0079761 | A1* | 4/2011 | Young | E04H 17/161 256/24 |
| 2014/0203233 | A1* | 7/2014 | Larsen | E04H 17/161 256/32 |
| 2015/0292170 | A1* | 10/2015 | Cochrane | E01F 13/022 256/13.1 |
| 2015/0322636 | A1* | 11/2015 | Lyhamn | E01F 7/02 256/12.5 |
| 2018/0283042 | A1* | 10/2018 | Cochrane | E04H 17/24 |

* cited by examiner

SECURITY BARRIER

BACKGROUND OF THE INVENTION

This invention relates to a security barrier.

South African patent No. 2012/05346 describes a security fence which includes spaced apart vertical posts, mesh material secured to the posts and, between at least one pair of adjacent posts, vision-obscuring sheet material.

The vision-obscuring sheet material is formed from a plurality of cladding components which abut one another to obstruct visibility. The mesh material has a substantial deterrent effect and the sheet material is employed primarily to obscure visibility, e.g. to maintain confidentiality of a particular location or object.

One particular application lies in the use of the cladding, also referred to as shutters, to protect electrical installations which include mechanisms such as substations, transformers, and so on, and to obscure visibility, from outside, of such installations. A factor which does arise though is that this type of installation does generate heat due to electrical losses and, ideally, air circulation past the installation, should not be completely restricted.

The present invention is concerned with a security barrier which has an enhanced deterrent effect primarily through the use of suitable sheet material and which can address, at least to some extent, the aforementioned issues.

SUMMARY OF THE INVENTION

The invention provides, in the first instance, a shutter for use in a security barrier, the shutter including a body of rectangular outline which is made from sheet material, and wherein the body has opposed first and second edges which in use extend horizontally and opposed third and fourth edges which in use extend vertically and wherein the body includes at least a first elongate reinforcing formation which is parallel to and positioned between the first and second edges, and a plurality of spaced apart apertures in the sheet material.

Each aperture may allow the passage of air through the aperture.

In one embodiment each aperture is formed so that visibility through the aperture is obscured wholly, or at least to a substantial extent.

The sheet material from which the body is formed may comprise a metallic sheet. Each aperture may be formed by punching a hole through the steel. In order to obtain the visibility—obscuring property referred to, each aperture may be formed by shearing a portion of the sheet material along a first path and deforming a part of the sheet material away from the first path. The aperture may be of any appropriate shape.

In one particular example of the latter embodiment each aperture may be in the form of an elongate slot which may be oriented so that the slot extends longitudinally and horizontally. A lower edge of the slot may be formed by the first path and an upper edge of the slot may be formed by a portion of the sheet metal which is deformed.

Each reinforcing formation, in cross-section, preferably has a generally V-shape.

The body may include a second elongate reinforcing formation which is spaced from and parallel to the first reinforcing formation.

A first plurality of the apertures may be positioned between the first and second reinforcing formations. A second plurality of the apertures may be positioned between the first reinforcing formation and the first edge.

The body may be reinforced by forming respective flanges at the third and fourth edges, for example by bending the sheet material at the third edge, and the fourth edge, in each case, through an arc which may be of the order of about 90°.

The invention further extends to a security barrier which includes a plurality of spaced apart vertical posts and, between each pair of adjacent posts, a plurality of shutters, each shutter being of the aforementioned kind and wherein the third and fourth edges of the shutter are secured to the respective posts.

The shutters may be positioned between each pair of adjacent posts so that a substantially continuous structure is created between the posts. Abutting edges of adjacent shutters may be secured to one another if required.

High density mesh panels may be secured to the posts. The panels may be parallel to and adjacent the shutters. The panels and the shutters may have generally conforming shapes, in cross section, so that each panel can closely abut a respective shutter or, depending on the relative sizes of the panels and the shutters, a number of shutters.

BRIEF DESCRIPTION OF THE DRAWINGS

The invention is further described by way of example with reference to the accompanying drawings in which.

DESCRIPTION OF PREFERRED EMBODIMENTS

Figure 1:
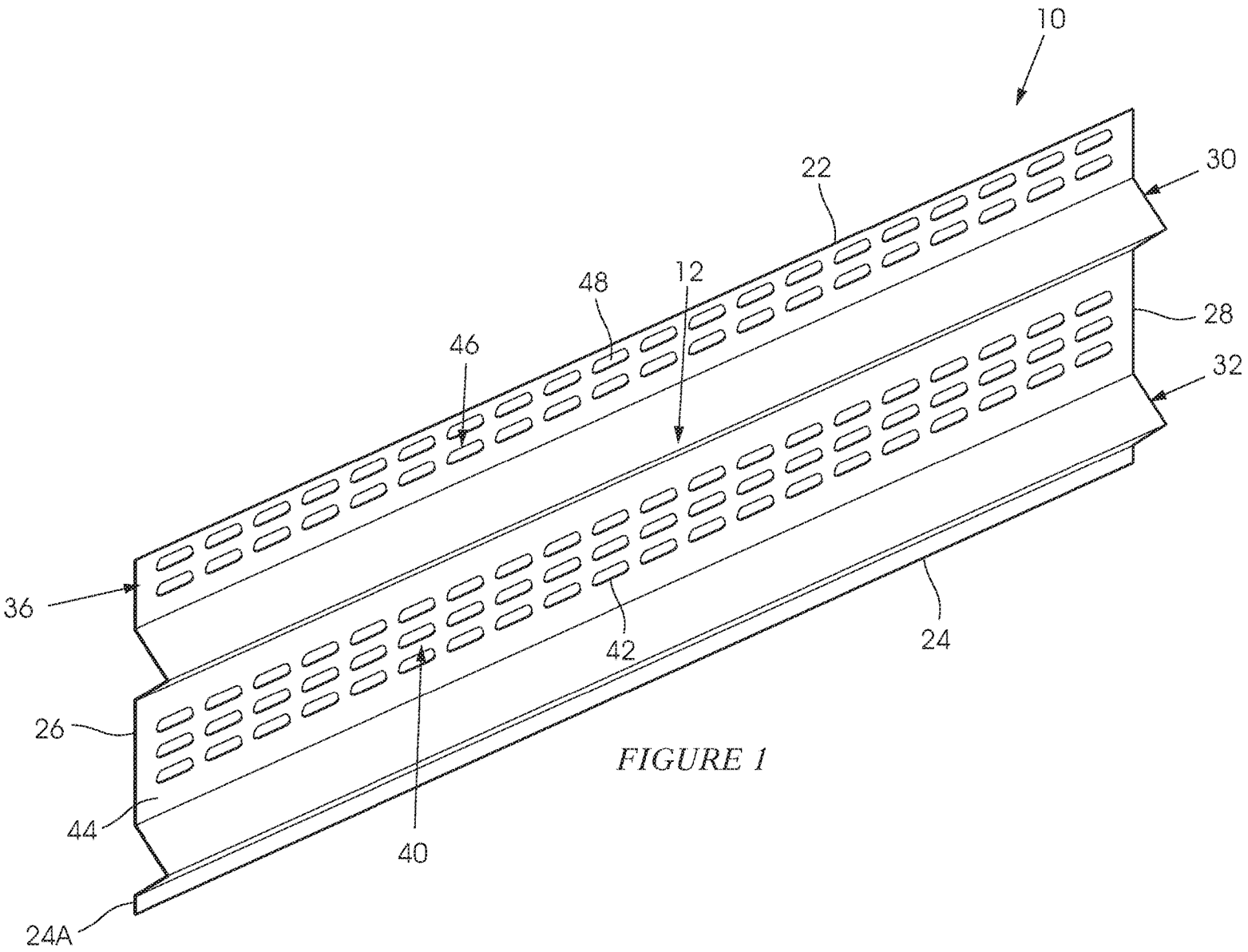
FIG. 1 illustrates in perspective a shutter according to the invention.

FIG. 1 of the accompanying drawings is a view in perspective of a shutter 10 according to the invention. The shutter has a body 12 which is made from a suitable metallic sheet material. The body is of rectangular form and has a length 14 and a width 16—see FIG. 2. The length typically is of the order of 3500 mm and the width 18 is of the order of 1000 mm. These dimensions, although preferred, are nonetheless exemplary and are non-limiting.

The rectangular body 12 has a first edge 22, an opposed second edge 24, and opposed third and fourth edges 26 and 28 respectively.

The body 12 has a first elongate reinforcing formation 30 and a second elongate reinforcing formation 32 which is spaced from and which is parallel to the first formation 30.

The formation 32 is close to the second edge 24 while the formation 30 is spaced from the first edge 22 by a portion 36 of the metallic sheet material. A flange 24A is adjacent the edge 24.

Figure 3:
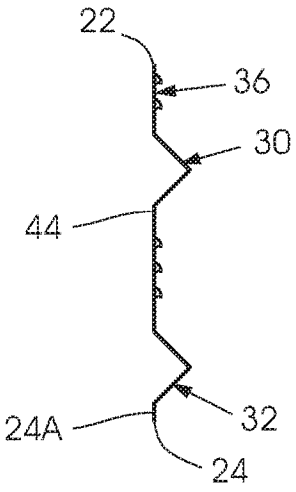
FIG. 3 is an end view of the shutter of FIG. 2.

Each reinforcing formation 30, 32 has a generally V-shape in cross-section—see FIG. 3.

A first plurality 40 of reinforcing formations 42 are formed in a planar portion 44 in the sheet material between the first and second reinforcing formations 30 and 32. A second plurality 46 of reinforcing formations 48 are formed in the sheet metal portion 36. The various formations 42 are identical to one another and to the various formations 48.

The flange 24A, the portion 44, and the portion 36 are co-planar.

Figure 4:
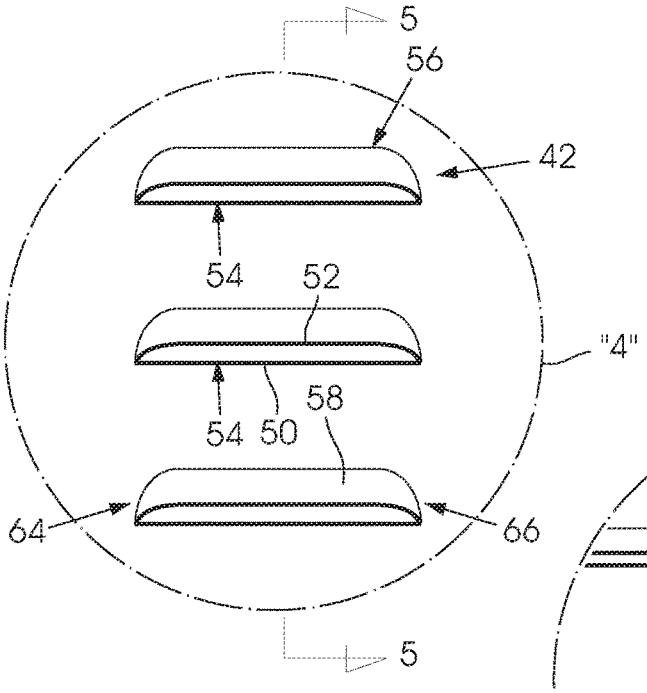
FIG. 4 is a view on an enlarged scale of a portion of the shutter marked "4" in FIG. 2.
Figure 4A:
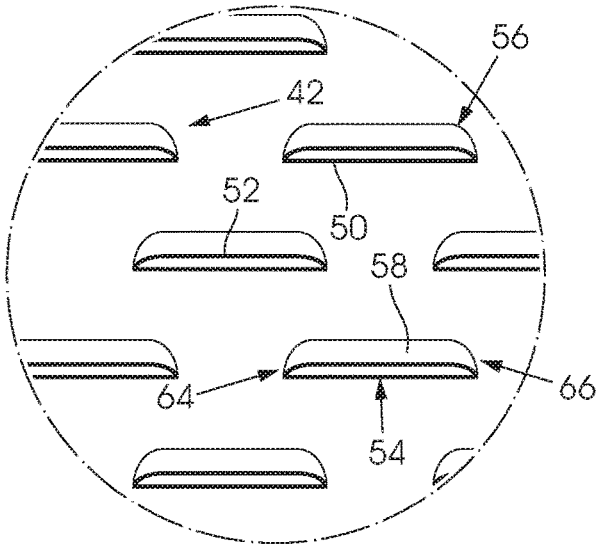
FIG. 4A is a view on an enlarged scale of an alternative embodiment of the portion of the shutter marked "4" in FIG. 2.
Figure 5:
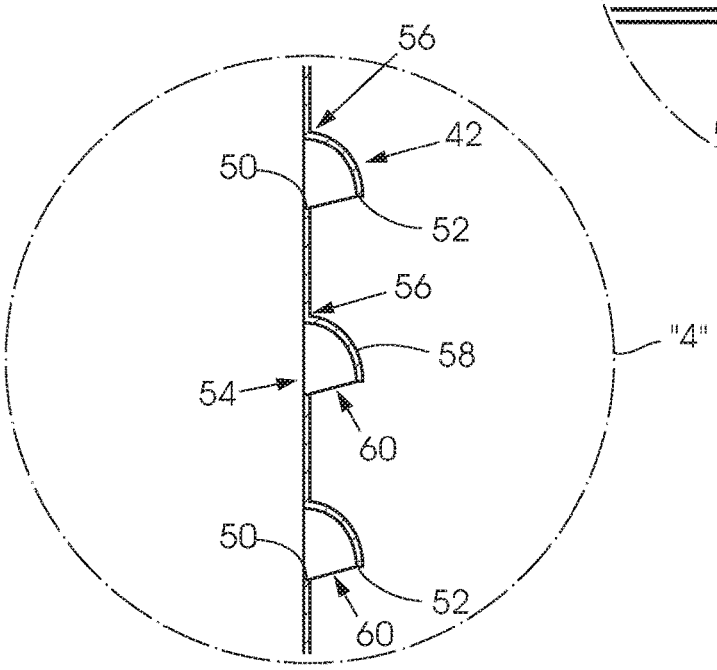
FIG. 5 is a view in cross-section of the shutter portion shown in FIG. 4 taken on a line 5-5 in FIG. 4.

FIGS. 4, 4A and 5 illustrate on an enlarged scale, from one side and in cross-section respectively, a portion "4" of the shutter (see FIG. 2) which includes several of the formations 42. Each formation 42 has lower edges 50 and 52 which are formed by shearing the sheet metal of the body along a linear first path 54. The formation 42 has an upper edge 56 which is defined by deforming a portion 58 of the sheet metal away from the first path 54 so that, in cross-section (FIG. 5), the portion 58 has a louvre-like appearance and extends outwardly and then downwardly leaving a gap 60 between the opposed edges 50 and 52. Ends 64 and 66 of the portion 58 are partly sheared and partly deformed and follow a generally bowed or arcuate shape.

Figure 2:
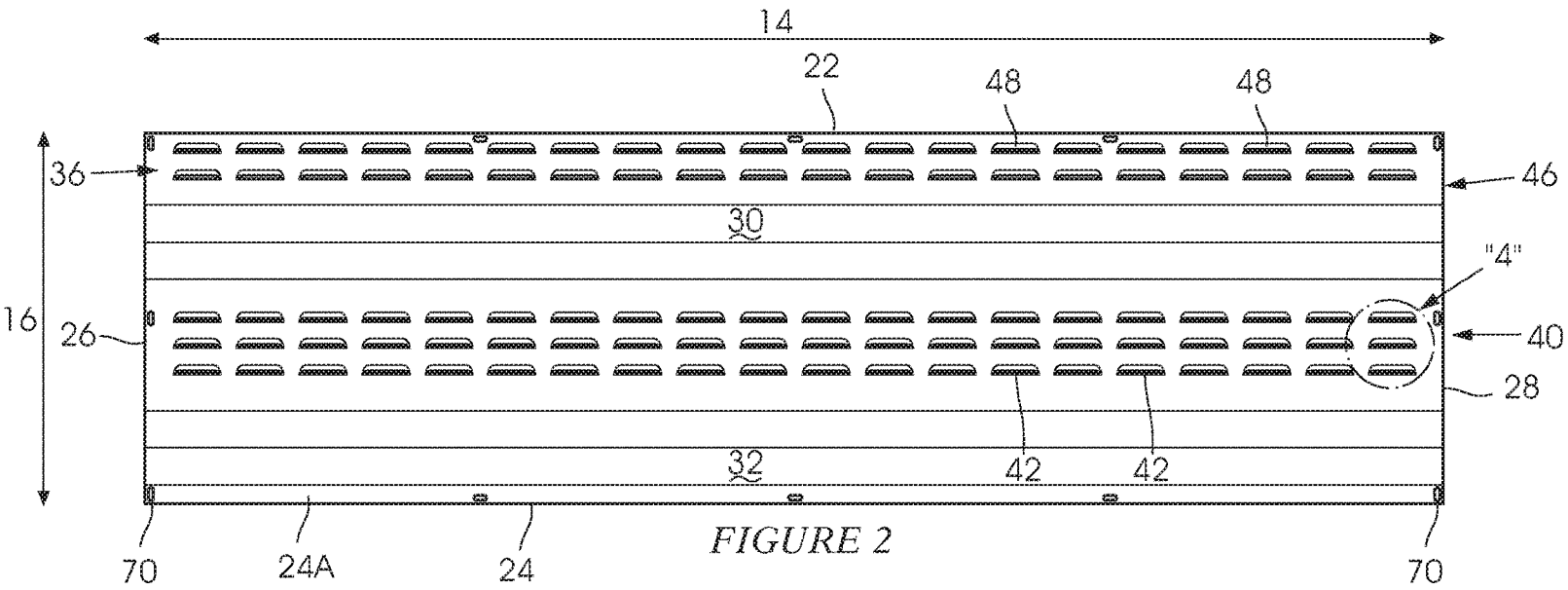
FIG. 2 shows the shutter of FIG. 1 in elevation.

Fixing formations 70 are formed at spaced apart locations on the third edge 26 and on the fourth edge 28 (FIG. 2).

Figure 6:
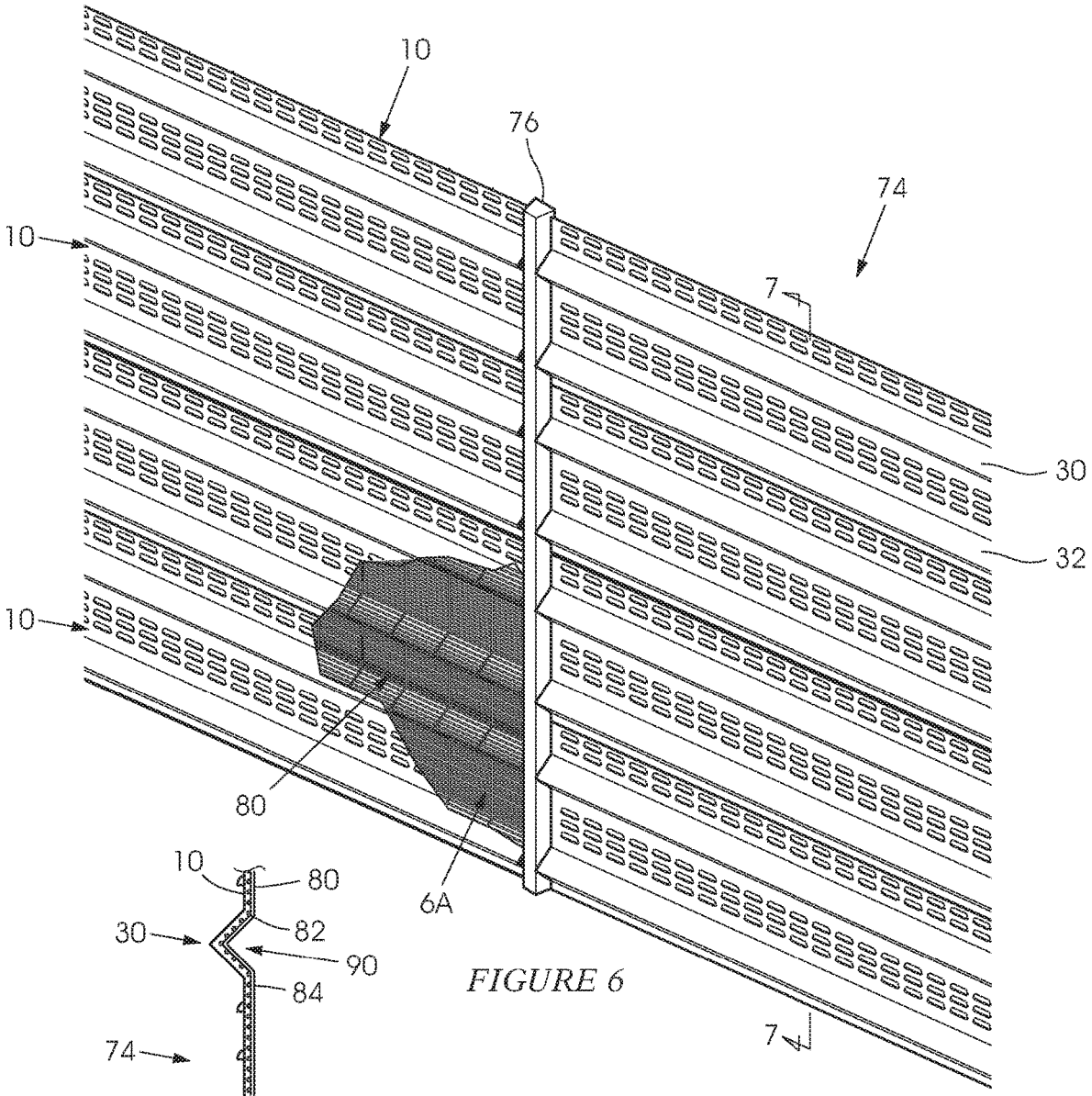
FIG. 6 illustrates a security barrier according to the invention which includes a plurality of shutters each of the kind shown in FIG. 1, and wherein one shutter is partly sectioned.

FIG. 6 illustrates a portion of a security barrier 74 according to the invention. The barrier 74 is formed from a plurality of spaced apart vertical posts 76 which are erected along a barrier line. Lower ends of the posts 76 are embedded in concrete in the ground. Thereafter a space between each pair of adjacent posts 76 is covered with a number of the shutters 10. The shutters are successively positioned between, and then fixed to, the posts 76 by means of appropriate fasteners which are engaged with the formations 70 and with the respective posts. As appropriate the flange 24A at a lower edge of an upper shutter overlaps and is fixed to the substantially co-planar portion 36 of an adjacent lower shutter. In this way a continuous, substantially vision-impervious barrier structure is formed.

The erected security barrier 74 has a substantial deterrent effect. The sheet metal shutters 10 are stiffened in a longitudinal direction by means of the reinforcing formations 30 and 32. Optionally, additional rigidity is imparted to each shutter by forming small flanges at the vertical edges 26 and 28. At each edge some of the sheet metal is bent through about 90° to form a flange which stiffens the sheet metal.

The various apertures 42,48 which are elongate and slot-like, allow a degree of air passage but offer minimal see-through visibility. It is noted that in FIG. 1 the apertures are in parallel rows and that the apertures in one row are adjacent the apertures in an adjacent row. If the apertures in one row are off-set relative to the apertures in another row as shown in FIG. 4A then, due to the deformation processes, the accumulative effect of the bent protruding portions 58 is such as to stiffen each shutter against bending about a vertical axis—this complements the anti-bending characteristic which is achieved through the use of the elongate reinforcing formations 30 and 32.

FIG. 6 also shows, in a partly sectioned portion "6A", that the shutters 10 can be used together with mesh panels 80 which are fixed to the, posts 76 to upgrade the security rating of the barrier.

Figure 7:
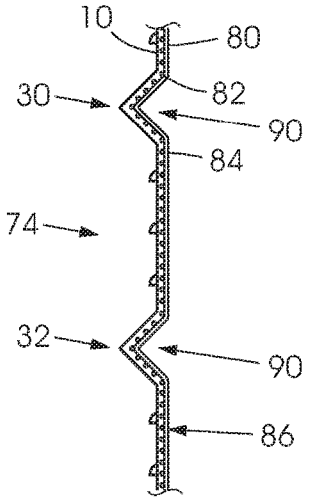
FIG. 7 shows a part of the barrier of FIG. 6 in cross section, taken on a line 7-7 in FIG. 6.

FIG. 7 is a cross sectional view of a portion of the barrier 74 showing a part of a shutter 10 and a part of an adjacent mesh panel 80.

The mesh panel 80, which is also fixed to the fence posts 76, is formed from a first set of parallel spaced apart steel rods 82 which are welded to a second set of parallel spaced apart transversely extending rods 84 at respective points of contact 86. The panel 80 is formed with V-shaped horizontally extending reinforcing formations 90 which are shaped and positioned similarly to the formations 30, 32, so that the panel can nest closely against the shutters 10 which are fixed to the posts.

The mesh panel 80 preferably has a high mesh density which is difficult to cut and which does not provide a foothold or handhold for an intruder to scale the panel.

The complementary shapes of the panel and the shutters, which allow the panel and shutters to nest closely together, work together to provide a significant barrier which substantially obscures see-through visibility but which, due to apertures 42, 48 in the shutters, and the mesh apertures in the mesh panel, still allow air-flow through the barrier.

Figure 8:
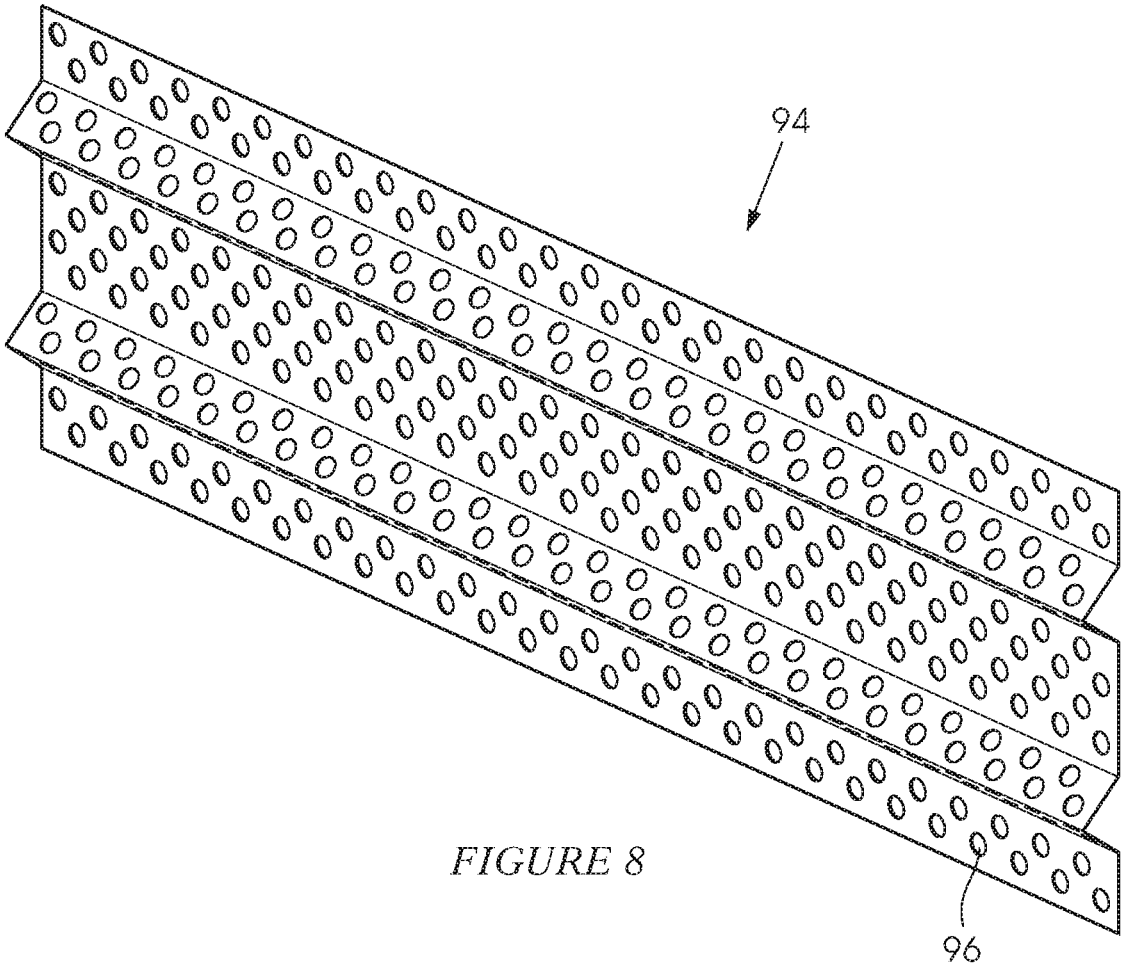
FIG. 8 shows a part of a shutter according to a variation of the invention.

The apertures which are formed in the sheet material are preferably shrouded with the louvre-like portions 58 which allow air passage but which restrict visibility. In a variation of the invention in which see-through visibility must be reduced to some degree only, but not essentially eliminated, apertures of any appropriate size and shape and density to permit air flow, can be formed through the sheet material, but without the shielding louvre-like portions. FIG. 8, for example, shows a portion of a shutter 94 through which are punched circular holes 96, in parallel spaced apart rows which are offset with respect to one another so that the sheet is not unduly weakened. The holes 96 allow air passage, for cooling purposes, and due to their size, restrict but do not eliminate a see-through capability.

The invention claimed is:

1. A shutter for use in a security barrier, the shutter comprising:

a body of rectangular outline made from sheet material, said body having opposed first and second edges which in use extend horizontally and opposed third and fourth edges which in use extend vertically, the body further comprising:

a plurality of parallel and spaced apart elongate reinforcing formations parallel to and positioned between the first and second edges, the plurality of reinforcing formations, in cross-section, having a V-shape;

a planar section of sheet material between each adjacent pair of reinforcing formations to form a plurality of planar sections that are co-planar with respect to each other; and a plurality of spaced apart apertures in each planar section of sheet material, with the plurality of reinforcing formations being free of apertures.

2. The shutter according to claim 1, wherein each aperture is formed by shearing a portion of the sheet material along a first path and deforming a part of the sheet material away from the first path.

3. The shutter according to claim 2, wherein each aperture is in the form of an elongate slot which is oriented so that the slot extends longitudinally and horizontally, and wherein a lower edge of the slot is formed by the first path and an upper edge of the slot is formed by a portion of the sheet metal which is deformed.

4. The shutter according to claim 1, further comprising: fixing formations spaced apart on the third and fourth edges.

5. The shutter according to claim 4, wherein the fixing formations are engaged with fasteners to fix the shutter to a post.

6. The shutter according to claim 1, wherein in use, the planar sections are substantially vertical.

7. The shutter according to claim 1, wherein the plurality of reinforcing formations extend in a direction transverse to each planar section.

8. A security barrier comprising a plurality of spaced apart vertical posts and, between each pair of adjacent posts a plurality of shutters, each shutter being according to claim 1, the shutters being positioned between each pair of adjacent posts so that a substantially continuous structure is created between the posts.

9. The barrier according to claim 8, further comprising a mesh panel between each adjacent pair of posts, and which is parallel to and adjacent the respective shutters which are secured to the posts.

10. The barrier according to claim 9, wherein the panel and the shutters, in cross section, have conforming shapes so that the panel is closely positioned adjacent a respective shutter or shutters.

* * * * *